United States Patent [19]

Richards

[11] Patent Number: 4,535,986

[45] Date of Patent: Aug. 20, 1985

[54] INCLINATION SIGNALING DEVICE ON A TENNIS RACQUET

[76] Inventor: Camille Richards, 18 Avenue Emile Deschanel, Paris, France, 75007

[21] Appl. No.: 418,968

[22] Filed: Sep. 16, 1982

[30] Foreign Application Priority Data

Sep. 30, 1981 [FR] France ..... 81 18435

[51] Int. Cl.[3] ..... A63B 49/08; A63B 69/38

[52] U.S. Cl. ..... 273/29 A; 273/73 J

[58] Field of Search ..... 273/29 A, 26 R, 26 B, 273/186 R, 186 A, 183 D, 54 B, 54 BA, 126 A, 127 R, 73 J; 200/80 B, 80 R, 61.1, 61.45; 46/232; 33/366

[56] References Cited

U.S. PATENT DOCUMENTS 2,253,796 8/1941 Livingston ..... 273/127 R
2,914,327 11/1959 Eineta ..... 273/126 A
2,927,286 12/1975 Fohl ..... 200/61.45 R
3,935,669 2/1976 Potrzuski et al. ..... 46/232

FOREIGN PATENT DOCUMENTS 211171 9/1960 Australia ..... 200/61.45 R
1379560 10/1964 France ..... 200/61.45 R

*Primary Examiner*—Richard C. Pinkham
*Assistant Examiner*—T. Brown
*Attorney, Agent, or Firm*—Karl W. Flocks; Sheridan Neimark

[57] ABSTRACT

An inclination signaling device with respect to the horizontal, namely associated with a racquet for a tennis game, comprising an enclosure having at least two juxtaposed planes forming a dihedral on which a ball contained in said enclosure can move, the first plane of the dihedral being arranged along the axis of the handle and perpendicularly to the plane of the stringed surface of the racquet, the second plane of the dihedral forming a maximum angle of 90° with said axis and said first plane, and comprising an electrical contact at its end opposite the line of junction of the first and of the second plane, said electrical contact being connected to a signaling device, whereby said ball is projected onto said electrical contact under the effect of the centrifugal force in the course of play by rolling over said second plane of the dihedral and provides a signal if the axis of the racquet is dipped downwards.

4 Claims, 9 Drawing Figures

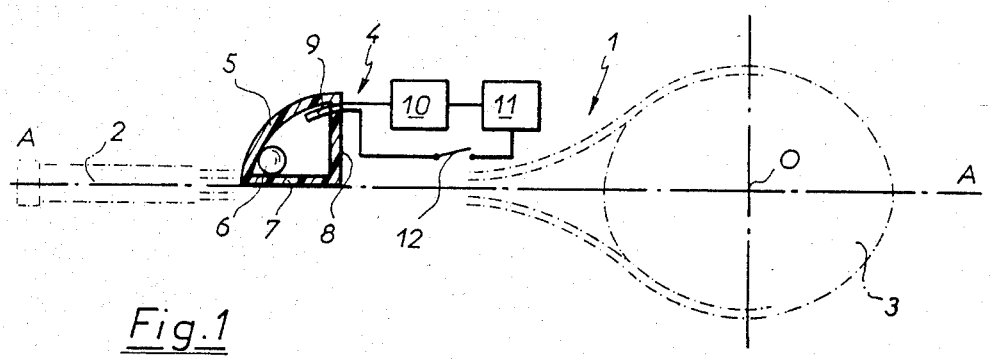
Fig.1
Fig.2
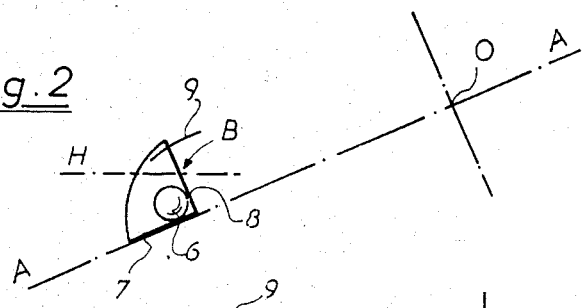
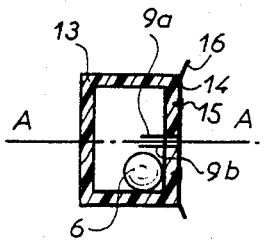
Fig.5b
Fig.3
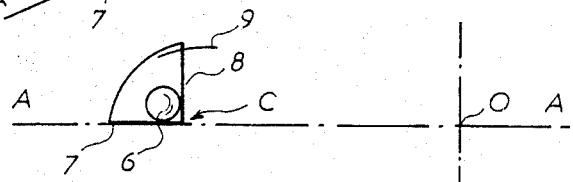
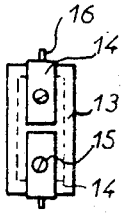
Fig.5c
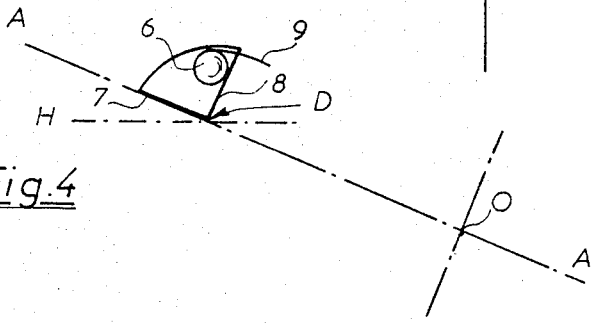
Fig.4
Fig.5d
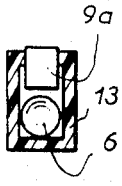
Fig.5a
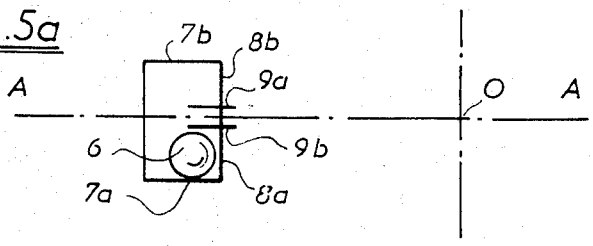
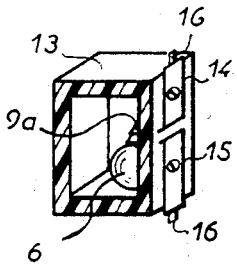
Fig.5e

INCLINATION SIGNALING DEVICE ON A TENNIS RACQUET

BACKGROUND OF THE INVENTION

The present invention relates to a device for signaling the inclination of an object with which it is associated, particularly a racquet, for example for the game of tennis.

It is known that the inclination or dip of the racquet with respect to the horizontal, in particular in tennis, constitutes a determining element for the quality of the playing. In this case, in fact, the axis of the handle can be held parallel with the ground, or can form with the horizontal an acute angle whose apex corresponds substantially with the player's wrist and the side along said axis is directed opposite the ground. In any case however, the position must not be such that the axis of the handle forms with the horizontal an angle whose side is directed towards the ground. In other words, the stringed surface of the racquet must be preferably directed upwards.

SUMMARY OF THE INVENTION

The present invention is therefore directed at a device for signaling the inclination applicable to a tennis raquet, triggering a suitable warning signal as soon as the handle is held in the above-mentioned incorrect position, in the course of play.

According to the invention, the device, of the mobile weight type cooperating with an electrical contact, comprises an enclosure having at least two juxtaposed planes forming a dihedral on which a ball can move, one plane of the dihedral being positioned along the axis of the handle and perpendicularly to the plane of the stringed surface of the racquet, the other plane forming a maximum angle of 90° with said axis and having at its end the electrical contact, itself connected to signaling means.

According to another characteristic, the electrical contact comprises at least one conducting blade having a flexibility such that it is placed in contact by the ball when the latter is subjected to the centrifugal force due to the movement of utilizing the racquet.

BRIEF DESCRIPTION OF THE DRAWINGS

Other features and advantages of the invention will become clear from the description which follows of several possible embodiments, given in conjunction with the accompanying drawings in which:

FIG. 1 shows a diagrammatic view of the device according to the invention, applied to a tennis racquet;

FIGS. 2, 3 and 4 show a diagram of three respective configurations of the embodiment of the device in FIG. 1, with respect to the horizontal;

FIG. 5*a* shows a diagrammatic view of a modification of the embodiment of FIG. 1; and FIGS. 5*b* to 5*e* show diagrammatic views of the embodiment according to FIG. 5*a*, respectively in front elevation and on the side of the contacts, from the top and and in perspective.

In these drawings, the same reference numerals denote the same elements.

DESCRIPTION OF PREFERRED EMBODIMENTS

Referring to FIG. 1, a racquet, referred to generally as 1, comprises a handle 2 with a longitudinal axis A—A on which is included the center 0 of the stringed surface 3. The device according to the invention, denoted generally by 4 shown on a very much enlarged scale with respect to the racquet 1, comprises an enclosure 5 in which is placed a free ball 6 forming a mobile mass. The enclosure 5 comprises at least one dihedral formed by two juxtaposed planes, the first plane 7 being arranged along the axis A—A and perpendicularly to the plane of the surface 3, the second plane 8 forming a maximum angle 90° with the plane 7 or the axis A—A and, preferably, a smaller angle. The end of the plane 8 opposite the plane 7 is provided with an electrical contact 9, with two blades mounted in line in manner known in itself with a supply source 10 and a signaling means 11 such as a vibrator or "buzzer", or any other sounding or luminous member. A general on-off switch 12 may advantageously be mounted in the circuit.

The whole of the device according to the invention is of sufficiently small size and can be conveniently mounted in the handle of the racquet or at any other place desired on the latter, including here outside the handle 1.

Referring to FIGS. 2 to 4, there are shown diagrammatically three operating configurations with respect to the horizontal, it being understood that the ball 6, in the course of playing is subjected to the centrifugal force tending to direct it in the direction of the central point 0, that is to say against the plane 8.

According to FIG. 2, the axis A—A of the handle is inclined upwards in correct position. The ball comes up against the plane 8 whose obtuse angle B with respect to the horizontal H prevents it from reaching the contact 9.

In FIG. 3, the axis A—A is practically coincident with the horizontal and the angle C (substantially a right angle) of the plane 8 again prevents the ball from reaching the contact 9.

In FIG. 4, the axis A—A is dipped downwards, in incorrect position. The acute angle D of the plane 8 with respect to the horizontal H permits the ball to reach the contact 9 by rolling over said plane 8 under the effect of the centrifugal force.

The flexibility of the blade closest to the plane 7 is such that the simple weight of the ball 6, at rest and in inverted position, is not sufficient to bring it into contact with the second blade. Under these conditions, the device according to the invention gives an incorrect position signal only under the actual conditions of playing.

Referring to FIG. 5*a*, a modification of the device described above comprises a housing 13 symmetrical with respect to the axis A—A and including the two dihedrals formed respectively from the planes 7*a*–8*a* and 7*b*–8*b* provided with two contact strips 9*a*, 9*b* on the side of the stringed surface and mounted in line in the circuit, which can cooperate with the ball 6 under the same conditions as previously. This arrangement enables the manipulation of the racquet whose stringed surface, which is generally in a plane perpendicular to the plane of the ground during play, may have effected a rotation of 180° around the axis A—A. Referring to FIGS. 5*b* to 5*e*, the device corresponding to the diagram of FIG. 5*a* comprises a parallelepipedic housing defining the dihedrals 7*a*–8*a* and 7*b*–8*b*, and constructed of an insulating material. Planes 8*a*–8*b* constitute a wall of housing 13 perpendicular to axis A—A while planes 7*a*–7*b* constitute two longitudinal walls of said housing and respectively form the two dihedrals 7*a*–8*a* and

*7b–8b* with said perpendicular wall. The strip contacts *9a–9b* project inside the housing, substantially in the axis A—A of the racquet. They advantageously form a bracket of which one respective wing 14 is fixed outside the insulating housing 13, for example by means of screw 15, and extended by a suitable connecting-lug 16. According to this embodiment, the ball 6 may be of steel, of about 6 to 9 mm. in diameter, the width of the housing 13 being very slightly greater than the diameter of the ball so that the latter is guided throughout in moving freely in said housing, particularly under the effect of centrifugal force in the direction of the strips *9a, 9b.*

It is of course well understood that the present invention has only been described and illustrated by way of explanation but not in any way limiting and that any useful modification could be introduced therein, particularly within the field of technical equivalents, without departing from its scope.

What is claimed is:

1. A device mounted in the handle of a racquet for signaling the inclination of said handle with respect to the horizontal, said racquet having a stringed surface, comprising an enclosure symmetrical with respect to the axis of said handle having dihedrals each formed by two juxtaposed planes on which a ball contained in said enclosure can move, the first plane of each dihedral being arranged along the axis of the handle and perpendicularly to the plane of said surface of the racquet, the second plane of each dihedral forming a maximum angle of 90° with said axis and said first plane, and comprising an electrical contact on the planes of the two dihedrals directed towards said stringed surface, said electrical contact being arranged substantially along said axis and being connected to signaling means, whereby said ball is projected onto said electrical contact under the effect of the centrifugal force in the course of play by rolling over said second plane of one of each dihedral and provides a signal provided the axis of the racquet is dipped downwards.

2. A device according to claim 1 wherein the electrical contact is constituted by two conducting blades having a flexibility such that they are placed in contact by the ball when the latter is subjected to the centrifugal force due to the movement of using the racquet.

3. A device according to claim 1 wherein the junction line of each two planes of each dihedral is arranged on the side directed towards the string surface of the racquet.

4. A device according to claim 1 wherein said signaling means comprises an electrical supply source and, in line in the circuit of said supply, said electrical contact forming a switch and a buzzer.

* * * * *